United States Patent [19]

Martin

[11] Patent Number: 4,515,042

[45] Date of Patent: May 7, 1985

[54] SERVICE TOOL MEANS FOR RACK AND PINION STEERING SYSTEMS

[75] Inventor: Tony E. Martin, Cahokia, Ill.

[73] Assignee: Moog Automotive, Inc., St. Louis, Mo.

[21] Appl. No.: 479,510

[22] Filed: Mar. 28, 1983

[51] Int. Cl.[3] ..... B25B 13/06

[52] U.S. Cl. ..... 81/55

[58] Field of Search ..... 81/55, 56, 121 A

[56] References Cited

U.S. PATENT DOCUMENTS

| | | | |
|---|---|---|---|
| 2,599,489 | 6/1952 | Schmidt | 81/3 |
| 2,693,729 | 11/1954 | Lindsey | 81/121 A |
| 2,736,220 | 2/1956 | Kamuk | 81/55 |
| 3,314,316 | 4/1967 | Finkle | 81/55 |
| 3,889,558 | 6/1975 | Duncan | 81/55 |
| 3,891,181 | 6/1975 | Sanders | 81/56 |
| 3,935,760 | 2/1976 | Taylor | 81/55 |
| 4,393,583 | 7/1983 | Zwald | 81/55 |

*Primary Examiner*—James L. Jones, Jr.

*Attorney, Agent, or Firm*—Gravely, Lieder & Woodruff

[57] ABSTRACT

Service tool means for rack and pinion steering assemblies operably connected to the steerable wheels through tie rods extending from outer ball joints adjacent the wheels to inner ball joints connected to the ends of the rack. The service tool is made up of cooperating telescoped bodies having substantially matching slots, each ending in an enlarged notch, for allowing the tie rod and its attached inner ball joint to be passed through the slots and assume a position in the inner body where jaw means carried by each body adjacent its enlarged notch engage the rack and the ball joint for the purpose of relatively turning the ball joint while preventing turning of the rack.

3 Claims, 9 Drawing Figures

29
32
37
38
37
3B
3B
29
37
37
4
28
38
36
35
35
23
25
32
27
4

29
37
36
28
35
23
22
32

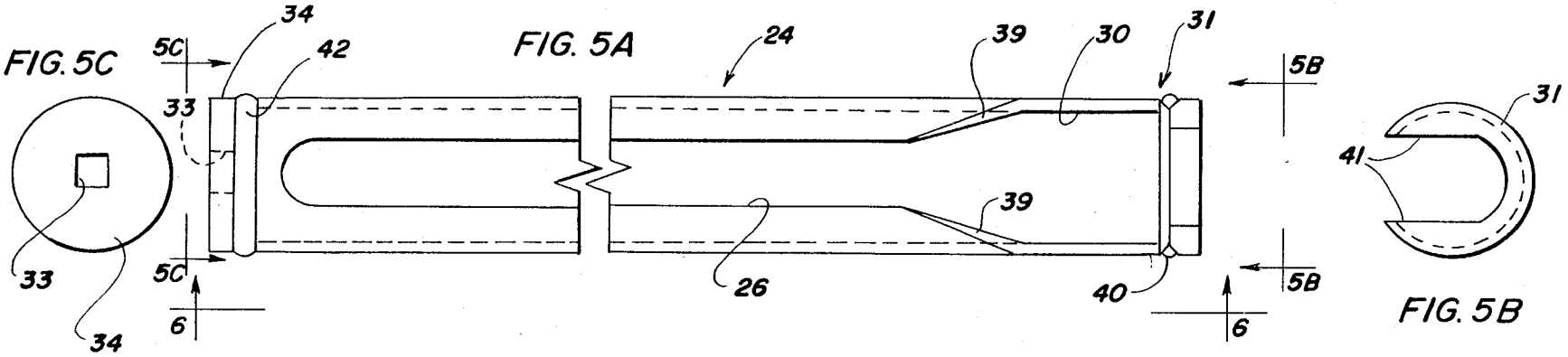
FIG. 5B
FIG. 5A
FIG. 5C
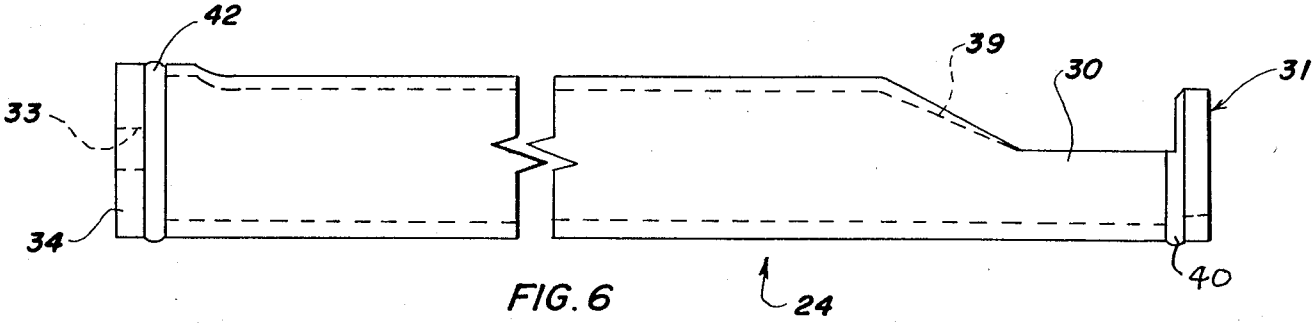
FIG. 6

SERVICE TOOL MEANS FOR RACK AND PINION STEERING SYSTEMS

BACKGROUND OF THE INVENTION

1. Field of the Invention

The present invention pertains to tool means for servicing a rack and pinion steering assembly without removal of the rack and pinion assembly from the vehicle.

2. Description of the Prior Art

Applicant is aware of tools having at least two relatively movable tool elements for holding one part of an assembly from turning while threading a second part of an assembly. One such tool is shown in Schmidt 2,599,489 of June 3, 1952 for adjusting the valve of an overhead valve engine. In this disclosure it is necessary, after threadedly positioning the stud into contact with the rocker arm push rod, to hold the stud stationary while rotating the stud jam nut. The stud adjusting screw driver passes through the tubular nut wrench.

Another example is Kamuk 2,736,220 of Feb. 28, 1956 which is a bolt-holding wrench for vehicle brake band adjustments for transmissions. This wrench is much like the Schmidt tool, and both examples of prior art are designed to approach the items from the ends which are exposed so there is no interference from surrounding structure, and the like.

BRIEF DESCRIPTION OF THE INVENTION

The steering systems for vehicles comprise what is generally referred to as a rack and pinion assembly in which a housing fixed to the vehicle carries a rack bar which is moved axially through the housing by a pinion gear engaged on the rack teeth. The rack bar has ends, each of which is threadedly engaged by a ball joint housing, and each housing carries a ball element which forms the inner end of a tie rod forming the link between the rack and the steering arm at the steerable wheel.

The rack and pinion steering system has presented problems to service mechanics because of the expense to vehicle owners when it becomes necessary to service the steering system. Generally, it has been necessary to remove the rack and pinion assembly so the ball joint housings could be removed from the rack bar without damaging the gear connected to the rack bar. Unthreading the ball joint housing requires holding the rack bar against turning so the drive pinion will not be damaged. The problem in removing the ball joint housing is that it is crimped or keyed onto the end of the rack bar so there will be no danger of the ball joint housing working loose from the rack bar during use.

The problem with steering systems is that, unlike the prior art disclosures, the rack bar must be connected to the tie rods which are connected to each end of the rack bar by a ball joint assembly. The approach to the ball joint assembly is interfered with by the tie rod, and furthermore, the working space under a vehicle is limited. The servicing of the rack and pinion assembly thus poses a special problem which has been looked at as requiring bodily removal of the steering assembly after the tie rod outer ends have been disconnected from the steering arm on each wheel. The present tool means overcomes that problem by being able to accommodate the presence of the tie rod while being manipulated into contact with the ball joint housing and the adjacent end of the rack bar.

A preferred embodiment of the present invention is exemplified by a service tool means for vehicle rack and pinion steering assemblies having the opposite ends of the rack bar threadedly connected to ball joint assemblies on tie rods which extend into connection at the steering arms adjacent the steerable wheels. The service tool comprises a first tubular body open at one end and having a side open slot ending in a first notch at the opposite end of the body, a second tubular body having a closed end and a side open slot ending in a second notch at the opposite end, the second body being sized to telescope into said first body through its open end for locating the second notch in the area of the first notch, jaw means carried by each of the tubular bodies adjacent the respective notches, and means on each of the tubular bodies to enable the relative turning thereof to bring the respective side open slots and notches into alignment for passing a ball joint assembly and tie rod into the second body and for thereafter positioning the respective jaw means in engagement with a ball joint assembly and the adjacent rack bar to effect turning of the ball joint assembly relative to the rack bar.

BRIEF DESCRIPTION OF THE DRAWINGS

The present invention is illustrated in the accompanying drawings in a preferred form, wherein:

FIG. 5A is a longitudinal view of a second body of the tool showing the elongated slot and notch;

FIG. 5B is an end view taken along line 5B—5B in FIG. 5A;

FIG. 5C is an end view taken along line 5C—5C in FIG. 5A; and

FIG. 6 is a longitudinal view of the body seen in FIG. 5A taken along line 6—6.

DETAILED DESCRIPTION OF THE EMBODIMENT

Figure 1:
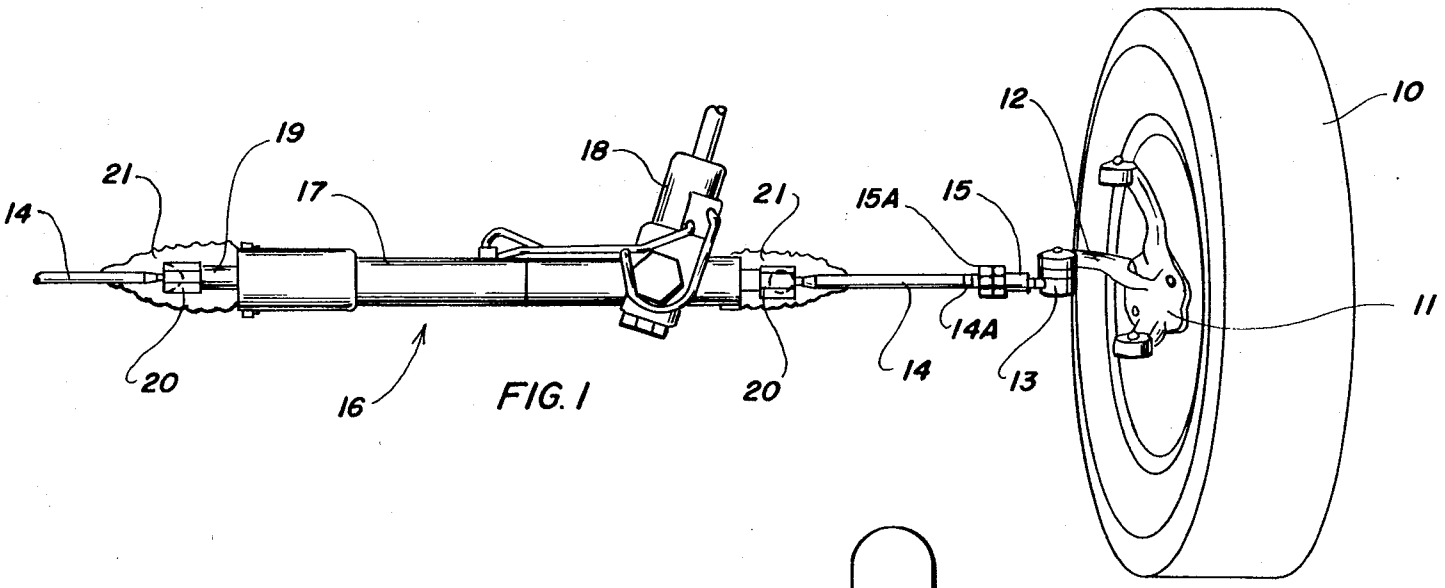
FIG. 1 is a general schematic view of a vehicle rack and pinion steering system in operative connection with a steerable wheel.
Figure 2:
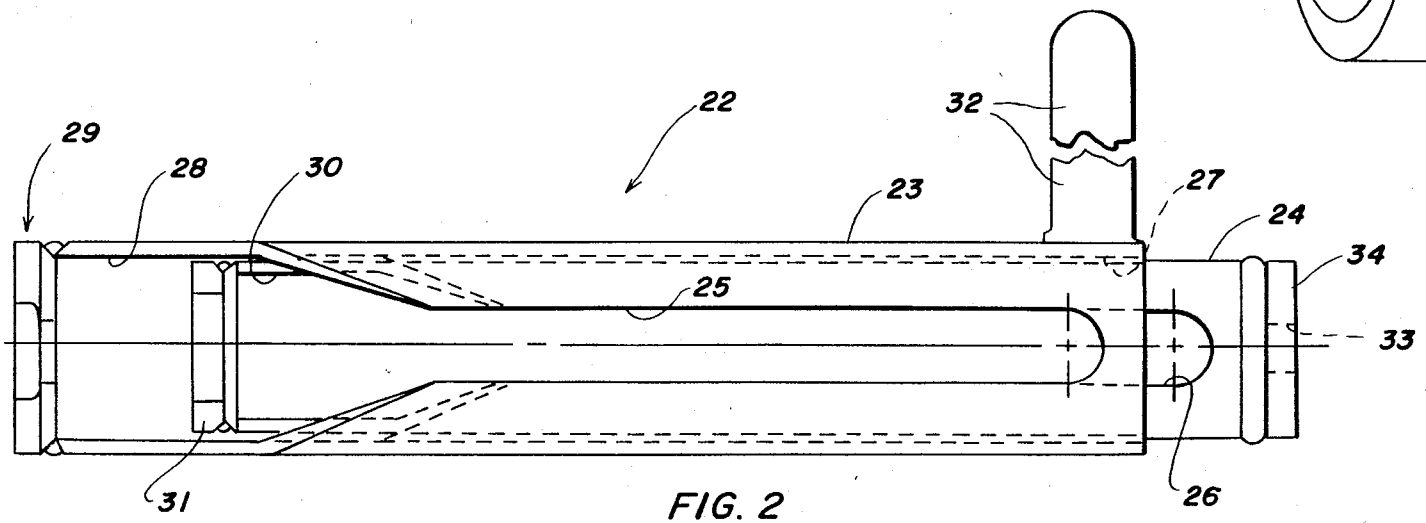
FIG. 2 is a general assembly view, on an enlarged scale of the service tool for rack and pinion steering systems.

A preferred embodiment of the present invention is shown in the general views of FIGS. 1 and 2. In FIG. 1 a steerable wheel 10 is illustrated in perspective in order to show the usual spindle 11 equipped with the usual steering arm 12 which is adapted to be connected through a ball joint 13 connected to the arm 12 and having a threaded socket in shank 15 and jam nut 15A engaged with the threaded outer end 14A of the tie rod 14. The wheel 10 is steered in response to the rack and pinion assembly 16 in which the cylinder 17 carries a pinion gear in a housing 18 for longitudinally shifting the rack bar 19 in the cylinder 17. The view of FIG. 1 illustrates a power drive for the pinion in housing 18, but this present invention is equally applicable to manual type drives and reference to rack and pinion steering shall be understood to include both power and manual types of rack and pinion steering assemblies. The rack bar has its opposite ends exposed for the purpose of receiving a threadedly mounted ball joint assembly 20 which includes the usual tie rod 14 which is integrally formed with the ball head of the ball joint as usual in this art. The connection between the ball joint assembly 20 and the exposed ends of the rack bar 19 is protected by a flexible boot 21 to keep out foreign matter.

It has been pointed out above that servicing of the ball joints in a vehicle rack and pinion assembly can be an expensive undertaking when the assembly 16 is disconnected from the vehicle and moved to a bench for replacement of the ball joint assembly 20. In order to carry out this servicing it is necessary to disconnect the tie rod 14 at each end of the steering assembly from the steering arm of the wheel. When servicing a rack and pinion steering assembly, such as may be necessary for removing the ball joint assembly 20, it is important to prevent the rack bar 19 from rotating while unthreading or threading up on a ball joint assembly. The rack bar 19 is formed with rack teeth which are engaged by a pinion gear in the housing 18, and rotation of the rack bar 19 would seriously damage the pinion gear drive.

Turning now to FIG. 2, in particular, there is shown in assembly, a service tool means 22 which is particularly useful in connecting and disconnecting the ball joint assembly 20 and its tie rod 14 from the rack and pinion steering assembly 16. The tool means is made up of a pair of telescopically joined elongated tubular bodies 23 and 24, each having an elongated slot 25 and 26 respectively which are of the same width so as to be moved into alignment when the body 24 is slidably inserted through the open end 27 of the outer tubular body 23. The elongated slot 25 of body 23 opens into a notch 28 and the end of the body 23 is provided with jaw means 29 which will later be referred to. The inner elongated body 24 is similarly formed with an open notch 30 adjacent one end and jaw means 31 is disposed adjacent the notch. It can be seen in FIG. 2 that when the body 24 is slidably mounted in the body 23 the open notches 28 and 30 respectively assume positions in which the jaw means 29 and 31 are relatively spaced, but with the jaw means 31 positioned in the open notch 28.

The service tool means of FIG. 2 is intended to be able to engage the exposed end of the rack bar 19 after the dust boot 21 has been removed so that flat surfaces normally provided on the exposed end of the rack bar can be engaged by the jaw means 29. The inner elongated body 24 is intended to be rotated initially to position its elongated slot 26 in alignment with the elongated slot 25 in the body 23 so that the tool means can be positioned under the vehicle to receive the tie rod 14 and allow it to pass through both of the slots 25 and 26. Thereafter, the notch 30 and the jaw means 31 are brought into engagement with the housing of the ball joint assembly 20 and jaw means 29 is engaged with the rack bar. Once the servicing tool has been properly positioned as described above, the operator will then be able to grasp the torque applying lever 32 which is affixed to the outer elongated body 23 and hold that body against displacement so as to prevent rotation of the rack bar 19 which is being held in the jaw means 29. The service operator will then be in a position to insert a suitable tool in the torque applying socket 33 carried by the end member 34 on the body 24. While the torque applying means 33 is shown as a socket, it is understood that instead of a socket the means 33 could be a projecting element on member 34 so that an open end wrench, or crescent wrench could be utilized for the purpose of rotating the inner elongated body 24 for either unthreading or threading up the ball joint assembly 20 on the end of the rack bar 19.

Figures 3A, 3B, 4:
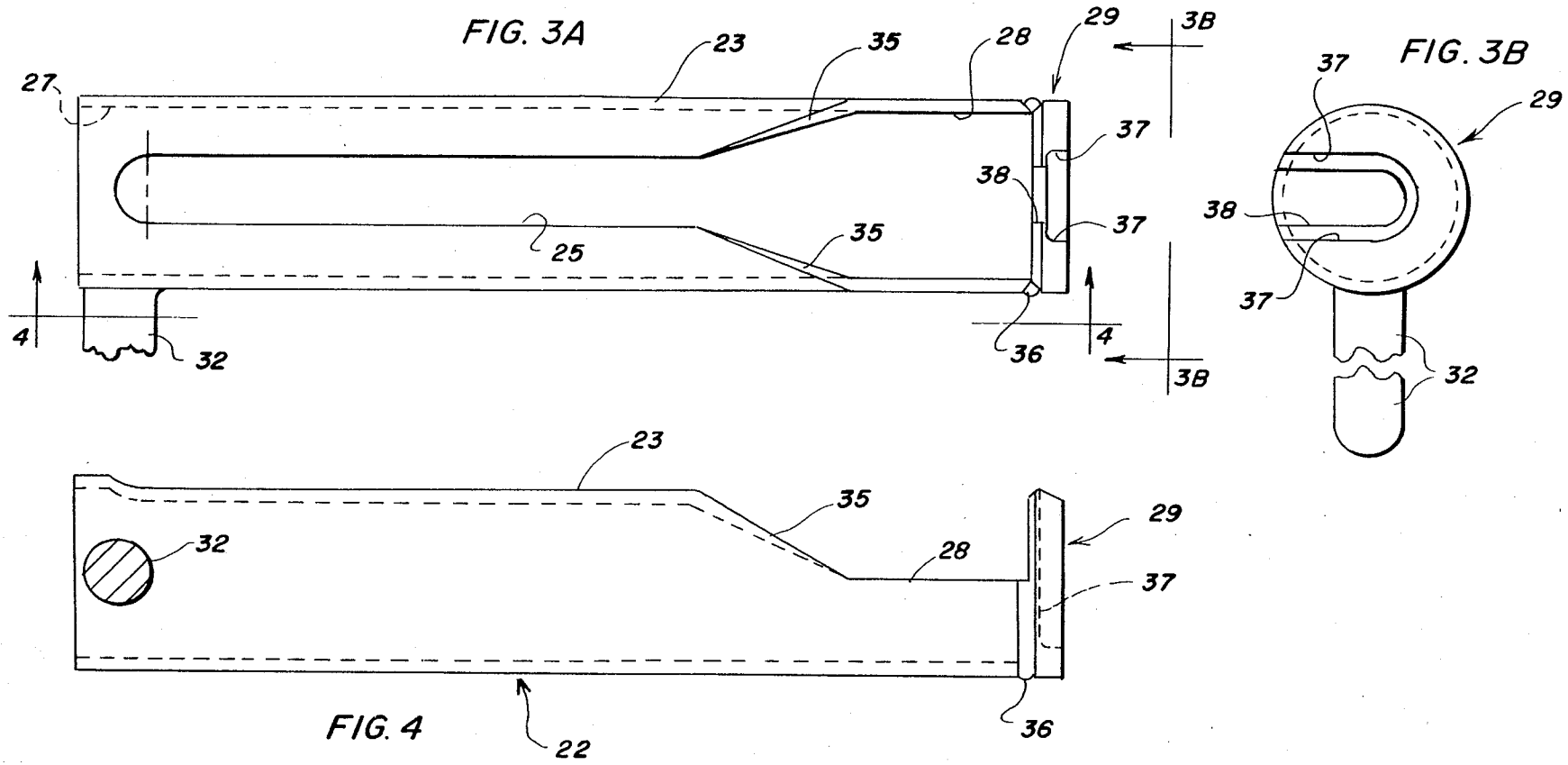
FIG. 3A is a longitudinal view of one of the bodies of the tool showing the elongated slot and notch.
FIG. 3B is an end view of the body of FIG. 3A seen from line 3B—3B.
FIG. 4 is a longitudinal view of the body in FIG. 3A as seen along line 4—4.

Reference will now be made to FIGS. 3A, 3B and 4 for a detailed disclosure of the characteristics of the elongated body 23. As shown, the body 23 is formed with an open end 27 which extends into the open notch 28 adjacent the opposite end of the body, and the wall portion of the body is cut away at surfaces 35 which diverge from the elongated slot 25. As seen in FIG. 4 the surfaces 35 are angled toward the mid position of the body 23 so as to expose at least half of the jaw means 29. The jaw means 29 is secured by welding 36 so as to provide a rigid and strong connection with approximately a semi-circular end surface on the body 23. The jaw means 29 is cut away at 37 to provide parallel spaced apart fixed surfaces for the purpose of engaging matching flat surfaces (not seen) on the rack bar 19. The jaw means 29 has a narrowed opening 38 which is adapted to fit into a matching locator surface on the rack bar end closely adjacent the normal fully assembled position of the ball joint assembly 20. When properly positioned the open notch 28 will fully accommodate the ball joint assembly 20.

Turning now to FIGS. 5A, 5B, 5C and 6, there has been illustrated the characteristics of the elongated body 24. In these views it can be seen that the body 24 is formed with an elongated slot 26 which opens into the notch 30 through the slanted surfaces 39 which form continuations of the slot 26. The open notch 30 is closed by the jaw means 31 being secured at the end thereof by a suitable weld 40. As seen in FIG. 5B, the jaw means 31 is formed with spaced surfaces 41 which are substantially parallel and rather widely spaced as compared to the surfaces 37 for the jaw means 29. The opposite end of the body 24 carries the torque applying means 34 which is formed with a square socket 33 for the reception of a matching tool capable of applying torque to the entire body 24 for rotating that body after it has been telescoped into body 23 through the open end 27 thereof. The torque applying means 34 is secured in position by a suitable weld 42.

The foregoing description of the preferred embodiment has set forth characteristics for a service tool means for servicing vehicle rack and pinion steering assemblies having the opposite ends of the rack bar threadedly connected to suitable ball joint assemblies. The assemblies form the inner ends of tie rods which are connected by ball joints 13 to the steering arms 12 adjacent the steerable wheels. It is set forth that the service tool means comprises a first elongated tubular body open at one end and having a side open slot ending in a first notch adjacent the opposite end of the body, second elongated tubular body having a side open slot ending in a notch, with this body being sized to telescope into the first mentioned elongated body from its open end, jaw means carried by the respective first and second tubular bodies in position to respectively grasp the rack bar and the adjacent ball joint assembly, and means for operating the first and second bodies for relative turning movement to accomplish two important objectives. The first objective is to be able to align the side open slots on these bodies so that the ball joint assembly and its tie rod can be passed through both slots and assume a position wholly within the second or inner tubular body. The second objective is to move the jaw means into engagement respectively with the rack bar and with the ball joint assembly for relative threading rotation whereby the ball joint assembly and its tie rod can either be removed from the rack bar without rotary displacement of the rack bar or assembled on the rack bar, also without rack bar rotary displacement.

There has been set forth above the characteristics of service tool means for use in connecting or disconnecting a ball joint assembly and tie rod from a rack bar in a vehicle rack and pinion steering assembly so that disturbance or damage to the drive pinion for the rack bar can be avoided. It is appreciated that variations in the structural characteristics disclosed for the preferred embodiment of the service tool means can come to mind after understanding the foregoing disclosure, and embodiments consistent with the scope of the disclosure are intended to be included as equivalents.

What is claimed is:

1. In a service tool means for use in servicing a rack and pinion steering assembly in which a ball joint threadedly connected to the end of the rack bar in the steering assembly has a diameter larger than the diameter of the end of a rack bar extending from the ball joint, the improvement in such a tool which comprises:

(a) a first elongated hollow body having at one side an open notch adjacent one end and an elongated slot extending from said side open notch toward the opposite end;

(b) first jaw means carried by said first body adjacent said open notch, said first jaw means having fixed elements providing a predetermined space therebetween for receiving a rack bar to be held by said first body against rotation;

(c) a second elongated hollow body operably supported within said first body, said second body having at one side an open notch adjacent one end and an elongated slot extending from said side open notch and substantially matching said elongated slot in said first body, said notches and elongated slots being sized for passing the tie rod and ball joint through said first body and into said second body;

(d) second jaw means carried by said second body adjacent said open notch, said second jaw means having fixed elements providing a predetermined space therebetween larger than said first mentioned jaw means for receiving the larger diameter ball joint to be held in said jaw means; and (e) force applying means carried by each of said first and second bodies for effecting turning of one of said jaw means relative to the other jaw means to thread said ball joint relative to said rack bar, said force applying means relatively rotating said first and second hollow bodies to bring said notches and elongated slots into alignment for the placement of said tool means over the ball joint housing and tie rod.

2. The service tool means set forth in claim 1 wherein said first and second bodies are axially movable for positioning said first and second jaw means in engagement with the rack bar and ball joint assembly respectively.

3. In a vehicle steering system which includes a rack bar and pinion assembly and a ball joint housing having a tie rod projecting from the housing, the improvement of a service tool for connecting and disconnecting the ball joint housing and projecting the tie rod from the rack bar of the rack bar and pinion assembly, said service tool comprising:

(a) first and second elongated tubular bodies each having elongated side open slots, said first tubular body having adjacent one end an enlarged notch extending from said side open slot and terminating in first jaw means, and said second tubular body having adjacent one end an enlarged notch extending from said side open slot and terminating in second jaw means, said first jaw means being of less size than said second jaw means and wherein (1) said first body is sized to telescopically receive said second body such that said side open slots and enlarged notches align to receive and pass over a ball joint housing and tie rod, (2) said first body enlarged notch being sized to receive said second body enlarged notch and its said terminating second jaw means therein, (3) said first jaw means being sized to engage a rack bar and said second jaw means being sized to engage a ball joint housing, and (b) torque applying means on each of said bodies for effecting relative rotation thereof whereby said first jaw means is enabled to retain the rack bar stationary and said second jaw means is free to turn within said first body to rotate the ball joint housing and tie rod together for selectively connecting and disconnecting the housing and rack bar.

* * * * *